US005372057A

United States Patent [19]

Hart

[11] Patent Number: 5,372,057

[45] Date of Patent: Dec. 13, 1994

[54] MUSICAL INSTRUMENT STRING ATTACHMENT MEANS

[76] Inventor: Joseph Hart, 6634 N. 55th St., Milwaukee, Wis. 53223

[21] Appl. No.: 167,448

[22] Filed: Dec. 15, 1993

Related U.S. Application Data

[63] Continuation of Ser. No. 890,540, May 28, 1992, abandoned.

[51] Int. Cl.[5] ..... G10D 3/00

[52] U.S. Cl. ..... 84/297 R; 84/297 S; 84/199

[58] Field of Search ..... 84/297 R, 297 S, 313, 84/199

[56] References Cited

U.S. PATENT DOCUMENTS

| | | | |
|---|---|---|---|
| 542,719 | 7/1895 | Wahner | 84/297 S |
| 1,363,902 | 12/1920 | Muller | 84/297 S |
| 4,138,919 | 2/1979 | Miller | 84/297 S |
| 4,202,240 | 5/1980 | Smith | 84/297 S |
| 4,377,963 | 3/1983 | Siminoff | 84/297 R |
| 4,453,443 | 6/1984 | Smith | 84/297 S |
| 4,589,321 | 5/1986 | Pritchard | 84/297 S |
| 4,735,124 | 4/1988 | Bernier | 84/297 S |

*Primary Examiner*—Michael L. Gellner
*Assistant Examiner*—Cassandra Spyrou
*Attorney, Agent, or Firm*—Ryan, Kees & Hohenfeldt

[57] ABSTRACT

A set of strings for a stringed musical instrument. Each string of the set is attached at one end to a bead to anchor the string in one of the bridge pins. The opposite end of the string is affixed to a pin having a diameter adapted to fit in the bore in a conventional post. The length of the string between the bead and the pin is at least equal to the distance between the bridge pin and the rotatable string post but not greater than the sum of said distance and the circumference of the post. Thus the post is tightened less than one revolution in order to tune the string.

1 Claim, 1 Drawing Sheet

MUSICAL INSTRUMENT STRING ATTACHMENT MEANS

This is a continuation of application(s) Ser. No. 07/890,540 filed on May 28, 1992, now abandoned.

BACKGROUND OF THE INVENTION

The present invention relates to an improved system for attaching a set of strings to a musical instrument such as a guitar.

Various string securing arrangements have been used for guitars and other stringed instruments. Active musicians may have to restring an instrument such as a guitar weekly. Typically, one end of the string has been attached to a bridge pin affixed to the body of the instrument and the opposite end threaded through a hole in a post rotatably positioned in the head of the instrument. This procedure is time consuming and moreover laminated strings used for lower frequency sounds are subject to delamination during repeated winding around the post. This is due to the fact that the tightening may simply apply stresses to the inner core of the string. Such delaminated strings are subject to changes in tone. A further disadvantage of this system is that the sharp end of the string can subject the musician to puncture wounds. An alternate system that has been utilized has been to provided double beaded strings wrapped around a groove around a hollow annular bead. The bead is placed over a post. A disadvantage of this system is due to the fact that conventional rotatable posts cannot be used in conjunction with the strings but rather a different system of attachment of the strings to the head has to be provided.

SUMMARY OF THE INVENTION

The present invention provides a new and improved system for attachment of strings to an instrument such as a guitar that avoids the foregoing difficulties. An important object of the present invention is to provide such strings that can rapidly be attached to existing musical instruments without the need for replacement of any of the parts thereof. A related object is to provide such a system which can be attached to the instrument at a fraction of the time required for conventional string attachment.

Briefly summarized, the present invention achieves these and other important objects and advantages by providing a set of strings each of which can be attached to a stringed musical instrument of conventional configuration. Such instruments generally have a body portion and a fingerboard portion which terminates in a head. The body portion is provided with a plurality of bridge pins, one for each of the strings. The end portion has positioned it in a plurality of rotatable string posts, also one for each string. In conventional fashion each of the posts is provided with a bore extending through the diameter thereof. Each string of the set is attached at one end to a bead, preferably a cylindrical disc having a circumferential groove around which the string is wound, the bead being of a size sufficient to anchor one end of the string in one of the bridge pins. The opposite end of the string is affixed to a pin having a diameter adapted to fit in the bore. The length of the string between the bead and the pin is at least equal to the distance between the bridge pin and the rotatable string post but not greater than the sum of said distance and the circumference of the post.

An important aspect of the invention is thus achieved by virtue of the fact that the string is attached by placement of the pin in the bore and the post is tightened less than one revolution in order to tune the string. Another advantage of the invention is the elimination of waste resulting from cutting and discarding the ends of the strings.

Other advantages and aspects of the invention will become apparent from the following description taken in conjunction with the accompanying drawings in which:

DRAWINGS

Figure 1:
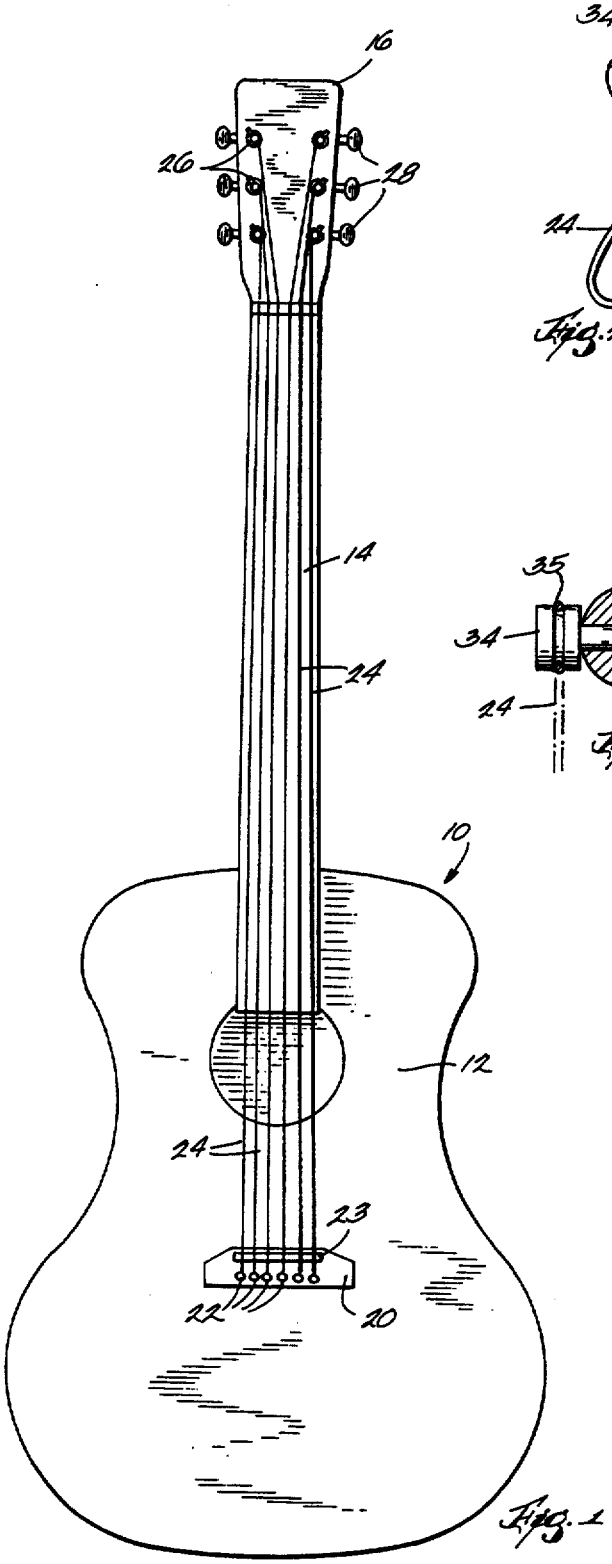
FIG. 1 is a top plan view of a guitar incorporating the present invention.

Referring specifically to FIG. 1 there is shown a guitar 10 having a body portion 12 and a finger board portion 14 terminating in a head 16. A body portion 12 has a bridge 20 attached thereto into which are fitted a plurality of pegs 22 for attachment of strings 24 to the body portion 12. The strings pass over a bridge insert 23 in conventional fashion. Head portion 16 is provided with a plurality of rotatable posts 26 for attachment of the other ends of strings 24 thereto. In conventional fashion posts 26 are provided with hand rotatable shafts 28 that are attached to rotatable posts 26 by means of conventional gear mechanisms.

Figure 2:
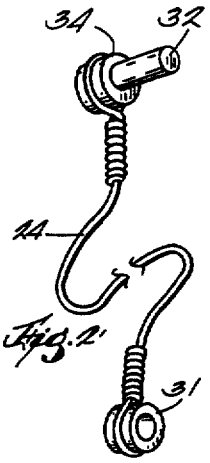
FIG. 2 is a perspective magnified view of a string according to an embodiment of the invention with a portion broken away.
Figure 3:
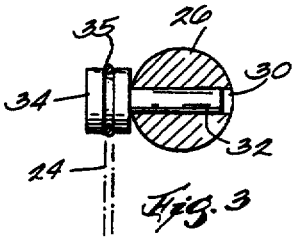
FIG. 3 is a cross-sectional view of a post of the musical instrument of FIG. 1 showing a string attached thereto in accordance with the invention.

As seen in FIG. 2 string 24 is attached at one end to a bead 31. The preferred configuration of bead 31 is that of a hollow cylinder having an annular groove around the circumference thereof into which the end of string 24 is secured by twisting as shown. The other end of string 24 is attached to a pin 32 which is secured within another bead 34. Bead 34 has an annular groove 35 around the circumference thereof as seen in FIG. 3 into which string 24 is secured, also by means of twisting as seen in FIG. 2. As seen in FIG. 3 pin 32 is of a diameter to fit in a bore 30 that fits through the diameter of post 26.

Figure 4:
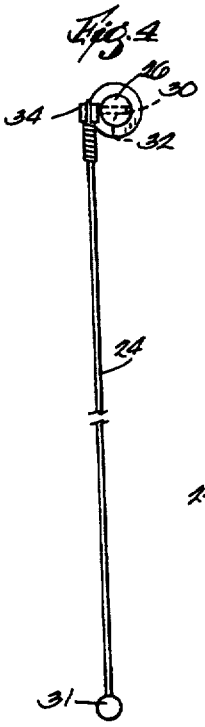
FIG. 4 is a top view of the post and string shown in FIG. 3.
Figure 5:
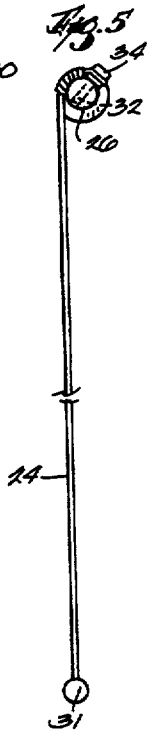
FIG. 5 is a top plan view of the post and string of FIG. 4 in the tightened position.

The length of string 24 between bead 31 and pin 32 is at least equal to the distance between the bridge pin 22 to which it is fitted and the post 26 to which it is attached. The length is less, however, than the distance between the bridge pin and the circumference of post 26. Thus, the string can be attached to bridge 20 by means of bridge pin 20 being anchored by bead 31 and the opposite end attached to post 26 by inserting pin 20–22 into bore 30 as seen in FIG. 4. When the string is tightened by rotation of post 26 as seen in FIG. 5, less than one revolution of post 26 is required. This results in a substantial reduction in problems with the need to continually retune string 24.

Figure 6:
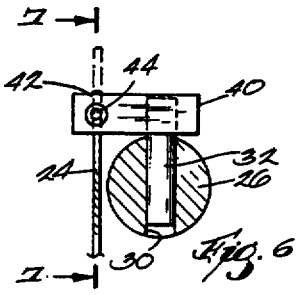
FIG. 6 is a cross-sectional view of a post of the instrument shown in FIG. 1 showing the attachment of a string thereto in accordance with a different embodiment of the invention.
Figure 7:
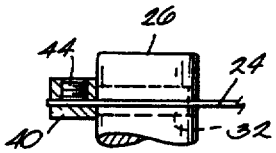
FIG. 7 is a cross-sectional view taken along line 7—7 of FIG. 6.

Referring to FIGS. 6 and 7, there is shown an alternate method of attachment of said string 24 to a post 32. In this case post 32 is anchored in a rectangularly-shaped block 40. Block 40 is provided with an opening or hole 42 into which string 24 is inserted. A set screw 44 is provided to secure string 24 in hole 42 and is rotatable, for example, by means of a hexagonal wrench to tighten the same securely against string 24. As also seen in FIGS. 6 and 7, less than a single revolution of post 26 is also required to tighten string 24 to provide the desired audible pitch.

The embodiment of FIGS. 6 and 7 also permits stringing of a conventional string through block 40. In such case, block 40 is installed first on peg 26. The end of string 24 is threaded through hole 42 and held in a hand-tightened position while set screw 42 is tightened to clamp the string in place. The peg is then rotated a partial turn to tune the string to the desired pitch.

While preferred embodiments of the invention have been described, it is to be understood that other modifications thereof may be made without departing from the spirit and scope of the appended claims.

What is claimed is:

1. In combination, a set of strings for stringing a stringed musical instrument and a musical instrument having a body portion and a finger board portion terminating in a head, a bridge on the body portion having a plurality of bridge pins, one corresponding to each of the strings of said set of strings, a plurality of rotatable cylindrical string posts each having a diameter and a circumference, one of said posts being provided for each string of said set of strings and being spaced a selected distance from a corresponding one of said bridge pins, and being rotatably positioned in said head, each of said posts being provided with a bore extending through the diameter thereof, each of said strings of said set being attached at one end to a bead of a size sufficient to anchor said one end of each of said strings in one of said bridge pins, an opposite end of each of said strings of said set being releasably affixed to a block by means of a set screw threaded in said block, each said block having attached thereto a pin which has a free end of a diameter adapted to fit in said bore, the length of each of said strings between said bead and said free end of said pin being adjustable to a length at least equal to said distance between the bridge pin and the rotatable string post corresponding to each of said strings, but less than a sum of said distance and the circumference of said post, said sum being obtained by mathematical addition of said distance and said circumference.

* * * * *